US009046067B2

(12) United States Patent
Brown et al.

(10) Patent No.: US 9,046,067 B2
(45) Date of Patent: Jun. 2, 2015

(54) DUAL FUEL INJECTOR WITH OFF SET CHECK BIASING SPRINGS

(71) Applicant: Caterpillar Inc., Peoria, IL (US)

(72) Inventors: Cory A. Brown, Peoria, IL (US); Adrienne M. Brasche, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 337 days.

(21) Appl. No.: 13/630,212

(22) Filed: Sep. 28, 2012

(65) Prior Publication Data

US 2014/0091159 A1 Apr. 3, 2014

(51) Int. Cl.
*F02M 63/00* (2006.01)

(52) U.S. Cl.
CPC ..... *F02M 63/00* (2013.01)

(58) Field of Classification Search
CPC ... F02M 63/00; F02M 63/0061; F02M 61/10; F02M 61/12; F02M 63/0012
USPC ..... 239/533.1, 533.2, 533.3, 533.4, 533.5, 239/533.9, 533.11, 584, 585.5
See application file for complete search history.

(56) References Cited

U.S. PATENT DOCUMENTS

| | | | | | |
|---|---|---|---|---|---|
| 3,764,076 | A * | 10/1973 | Eblen | 239/533.6 |
| 4,356,976 | A * | 11/1982 | Eblen et al. | 239/533.5 |
| 4,499,862 | A * | 2/1985 | Baumer et al. | 123/1 A |
| 6,073,862 | A | 6/2000 | Touchette et al. | |
| 6,422,199 | B1 | 7/2002 | Buckley et al. | |
| 6,761,325 | B2 * | 7/2004 | Baker et al. | 239/533.3 |
| 8,596,561 | B2 * | 12/2013 | Kim et al. | 239/585.5 |
| 2012/0325180 | A1 * | 12/2012 | Montgomery | 123/299 |

FOREIGN PATENT DOCUMENTS

| | | |
|---|---|---|
| JP | 61-229969 | 10/1986 |
| WO | 2012002620 | 5/2012 |

* cited by examiner

*Primary Examiner* — Justin Jonaitis

(57) ABSTRACT

A fuel injector has the ability to inject two fuels that differ in at least one of pressure, chemical identity and matter phase, such as liquid diesel fuel and nature gas. A first direct operated check includes a closing hydraulic surface exposed to fluid pressure in a first control chamber, and is normally biased toward a closed position by a first spring. A second direct operated check has a closing hydraulic surface exposed to fluid pressure in a second control chamber, and is biased toward a closed position with a second spring. The first spring and the second spring are located on opposite sides of a plane oriented perpendicular to a long axis of the injector body, in part to satisfy packaging constraints when the direct operated checks are arranged in a side by side parallel configuration.

20 Claims, 5 Drawing Sheets

DUAL FUEL INJECTOR WITH OFF SET CHECK BIASING SPRINGS

TECHNICAL FIELD

The present disclosure relates generally to dual fuel injectors, and more particularly to side by side direct operated checks with offset biasing springs.

BACKGROUND

Natural gas has increasingly become attractive as fuel for internal combustion engines. In one type of engine, a small quantity of injected liquid diesel fuel is compression ignited to in turn ignite a larger charge of natural gas. Delivery of these two fuels to the combustion space was originally contemplated utilizing two completely separate systems for supplying the two different fuels to the combustion space. More recently, there has been interest in attempting to supply the two fuels to the engine cylinder from a single fuel injector. For instance, U.S. Pat. No. 6,073,862 shows a fuel injector with the ability to inject gaseous and liquid fuels through two separate sets of nozzle outlets of a single fuel injector. This reference teaches the use of dual concentric check valve members for controlling the injection of the two separate fuels. While the art of fuel injectors shows several different fuel injectors with dual concentric checks for various purposes such as mixed mode (HCCI and diesel) systems, staged fuel injectors and others, the problems associated with the ability to mass produce consistently operating fuel injectors with dual concentric check valve members has resulted in few, if any, fuel injectors reaching the market with dual concentric check valve members for any reason. Thus, one might expect potentially insurmountable problems in attempting to manufacture a commercially viable dual fuel injector employing concentric check valve members.

The present disclosure is directed toward one or more of the problems set forth above.

SUMMARY

In one aspect, a fuel injector includes an injector body that defines a first fuel inlet, a second fuel inlet, a first nozzle outlet set and a second nozzle outlet set, and has disposed therein a first control chamber and a second control chamber. A first direct operated check includes a first check valve member with a closing hydraulic surface exposed to fluid pressure in the first control chamber. The first check valve member is movable between a closed position in contact with a first seat to block the first nozzle outlet set to the first fuel inlet, and an open position out of contact with the first seat to fluidly connect the first fuel inlet to the first nozzle outlet set. The first direct operated check also includes a first spring operably positioned to bias the first check valve member toward the closed position. A second direct operated check includes a second check valve member with a closing hydraulic surface exposed to fluid pressure in the second control chamber. The second check valve member is movable between a closed position in contact with a second seat to block the second nozzle outlet set to the second fuel inlet, and an open position out of contact with the second seat to fluidly connect the second fuel inlet to the second nozzle outlet set. The second direct operated check also includes a second spring operably positioned to bias the second check valve member toward the closed position. The first spring and the second spring are located on opposite sides of a plane oriented perpendicular to a long axis of the injector body.

In another aspect, a plurality of the fuel injectors previous described are utilized in a common rail fuel system. The first fuel inlet of each fuel injector is fluidly connected to a first common rail, and the second fuel inlet of each fuel injector is fluidly connected to a second common rail.

In still another aspect, a method of operating a fuel injector includes injecting liquid fuel through a first nozzle outlet set, and injecting a gaseous fuel through a second nozzle outlet set. The liquid injecting step includes relieving pressure on a closing hydraulic surface of a first check valve member by fluidly connecting a liquid fuel inlet to a drain outlet through a first control chamber. The gaseous fuel injecting step includes relieving pressure on a closing hydraulic surface of a second check valve member by fluidly connecting the liquid fuel inlet to the drain outlet through a second control chamber. A liquid injection event is ended by pushing the first check valve member toward a first seat with a first spring. A gaseous injection event is ended by pushing the second check valve member toward a second seat with a second spring located on an opposite side of a plane perpendicular to a long axis of the fuel injector from the first spring.

DETAILED DESCRIPTION

Figure 1:
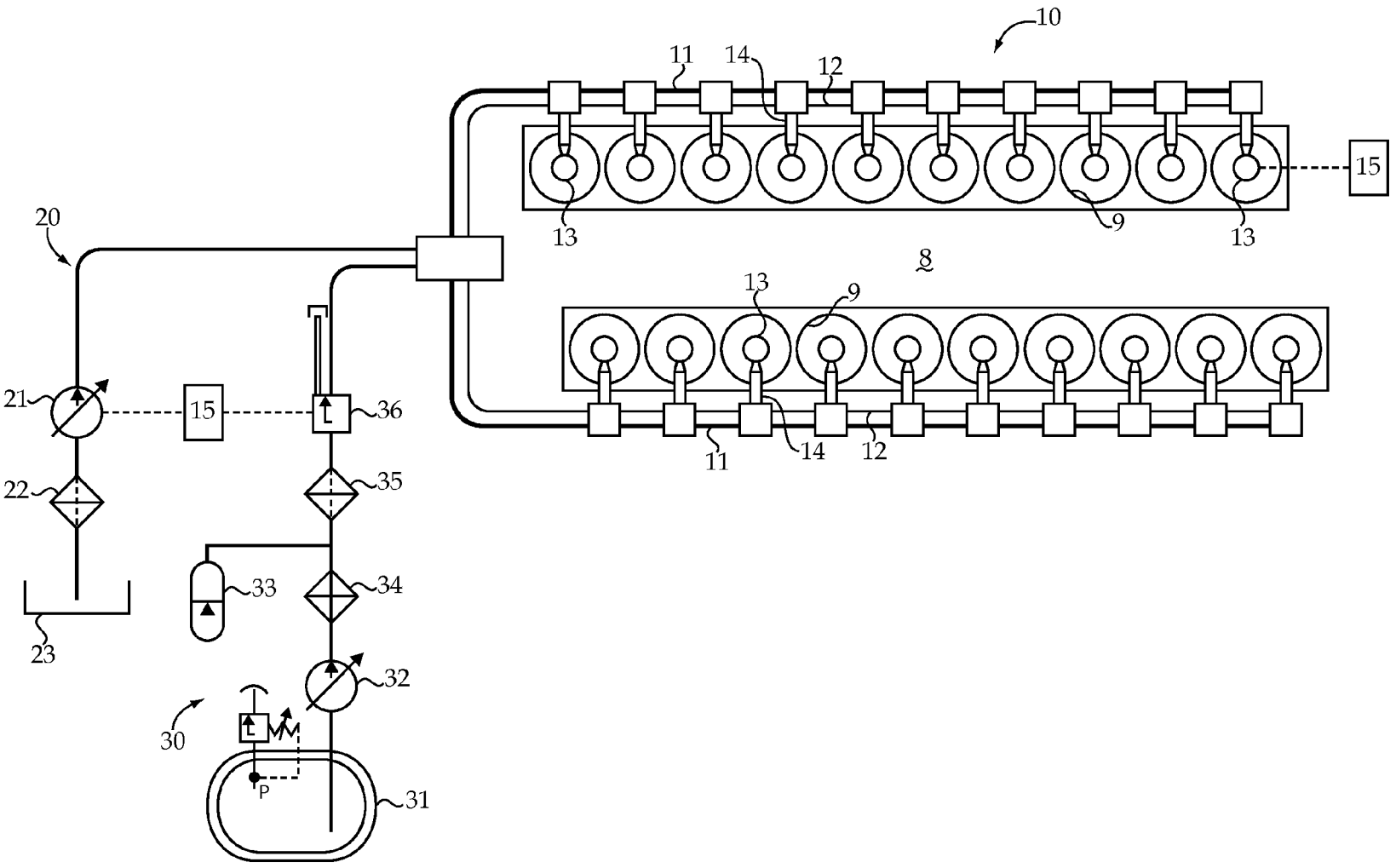
FIG. 1 is a schematic of a common rail fuel system according to one aspect of the present disclosure.
Figure 2:
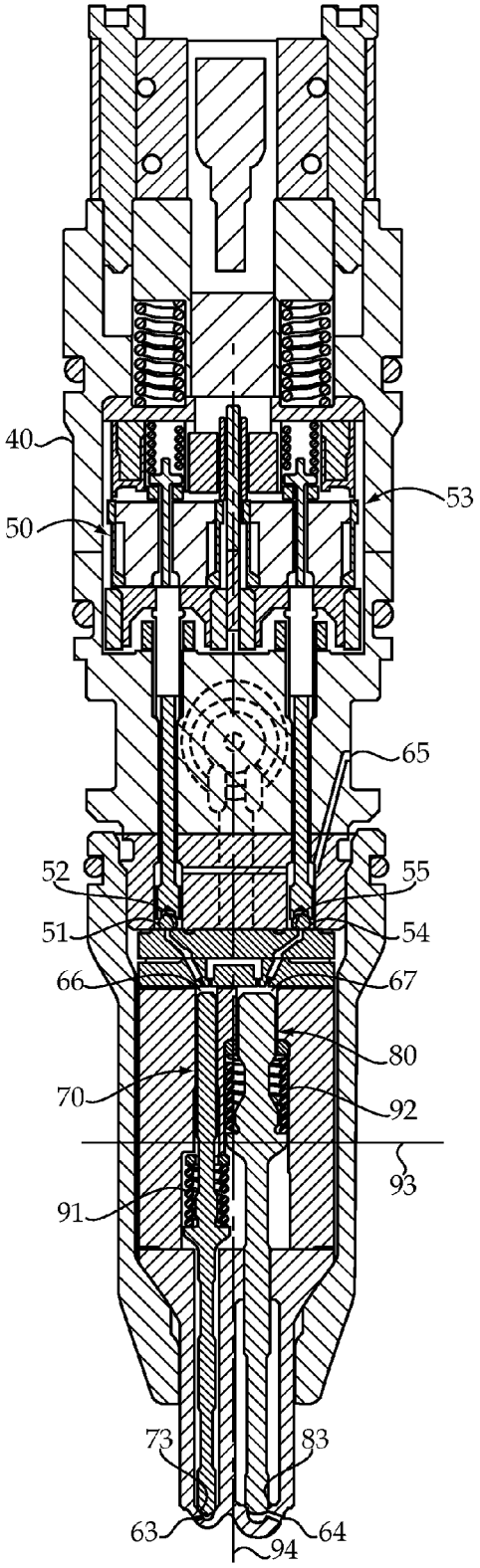
FIG. 2 is a front sectioned diagrammatic view of a fuel injector from the fuel system of FIG. 1.
Figure 3:
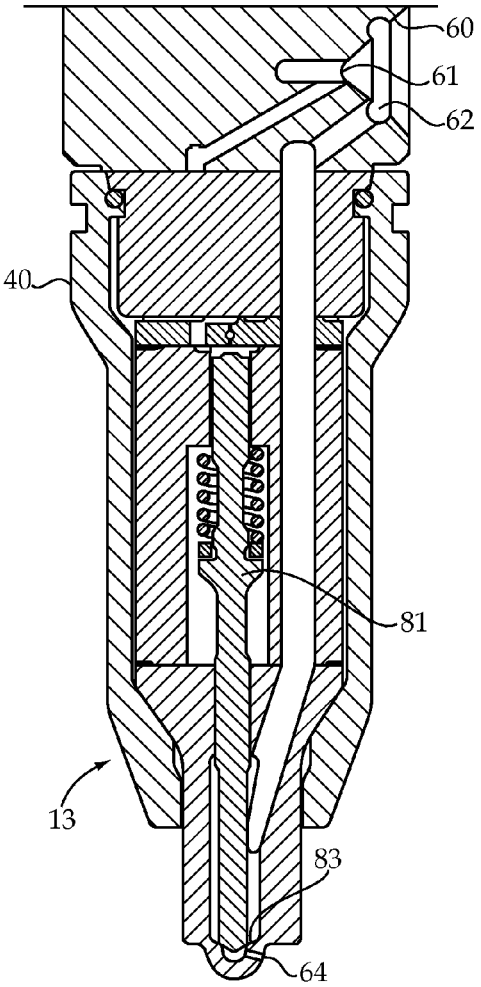
FIG. 3 is a partial side sectioned diagrammatic view of the fuel injector of FIG. 2.
Figure 4:
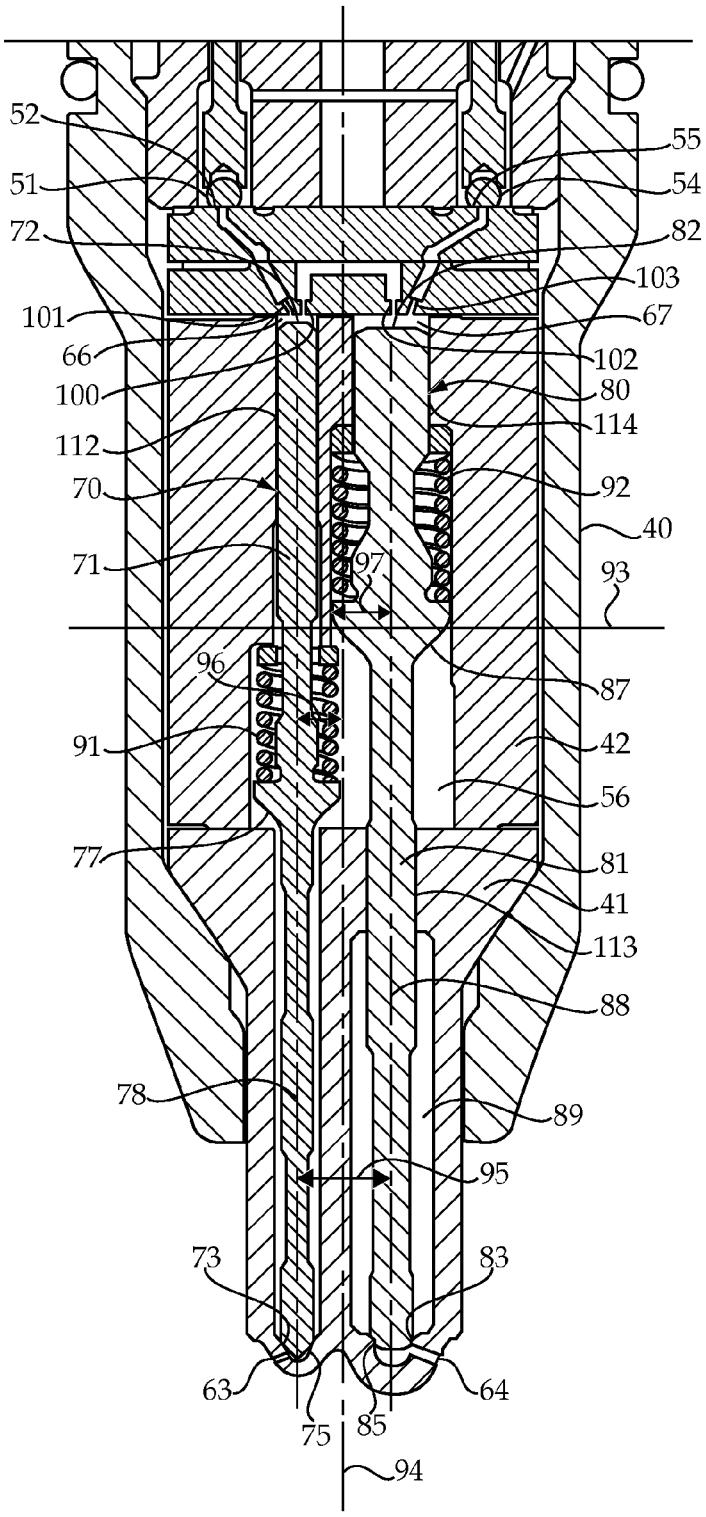
FIG. 4 is a enlarged partial front sectioned diagrammatic view of the fuel injector of FIG. 2.

Referring initially to FIGS. 1-4, an engine 8 is equipped with a common rail fuel system 10 that includes a plurality of fuel injectors 13 that are each mounted for direct injection into an individual cylinder 9. Each of the fuel injectors 13 includes an injector body 40 that defines a first fuel inlet 61 fluidly connected to a first common rail 11, and a second fuel inlet 62 fluidly connected to a second common rail 12. Although not necessary, both first fuel inlet 61 and second fuel inlet 62 may open through a common conical seat 60 facilitating the use of co-axial quill assemblies 14 to fluidly connect the common rails 11, 12 to the fuel injectors 13. In the illustrated embodiment, engine 8 is a multi-cylinder compression ignition engine in which a small injected quantity of liquid diesel fuel is compression ignited to in turn ignite a larger charge of natural gas. Nevertheless, the present disclosure could apply to different types of engines, including spark ignited engines. In addition, although engine 8 is taught in the context of two fuels that differ in pressure, chemical identity and matter phase, the present disclosure could also apply to engines utilizing two fuels that differ in less than all three of these categories.

Common rail fuel system 10 includes a liquid fuel supply system 20 that includes a pressure pump 21, a filter 22 and a tank 23. The high pressure pump 21 supplies liquid diesel fuel to, and controls pressure in, first common rail 11 responsive to control signals communicated from electronic controller 15 in a conventional manner. Common rail fuel system 10 also includes a gaseous fuel supply system 30 that includes a cryogenic fuel tank 31, a variable displacement pump 32, an accumulator 33, a heat exchanger 34, a filter 35 and a fuel conditioning module 36. Electronic controller 15 is in control communication with fuel conditioning module 36 to control the supply rate to, and pressure in, second common rail 12. In one aspect, the liquid common rail 11 may be maintained at a higher pressure (may be 5 MPa) greater than the pressure in gaseous fuel common rail 12, as one strategy to inhibit migration of gaseous fuel into the liquid side of common rail fuel system 10. Electronic controller 15 is also in control communication with each of the fuel injectors 13 to control the timing and duration of liquid and gaseous fuel injection events. Each injector body 40 also defines a drain outlet 65 that is fluidly connected (not shown) back to tank 23 recirculate fuel utilized by the fuel injectors 13 in controlling fuel injection events back to tank for recirculation.

Each injector body 40 defines a first nozzle outlet set 63, through which liquid fuel is injected into cylinders 9, and a second nozzle outlet set 64 through which gaseous fuel is injected. Disposed within injector body 40 are a first control chamber 66 and a second control chamber 67. Each fuel injector 13 includes a first direct operated check 70 that includes a first check valve member 71 with a closing hydraulic surface 72 exposed to fluid pressure in the first control chamber 66. The first check valve member 71 is movable between a closed position (as shown) in contact with a first seat 73 to block the first nozzle outlet set 63 to the first fuel inlet 61, and an open position out of contact with the first seat 73 to fluidly connect the first fuel inlet 61 to the first nozzle outlet set 63 to facilitate a liquid fuel injection event. Certain segments of the fluid passageways within injector body 40 that fluidly connect the first fuel inlet 61 to first nozzle outlet set 63 are not visible in any of the sectioned views of FIGS. 2-4. First check valve member 71 moves between its open and closed positions responsive to fluid pressure in first control chamber 66, which is controlled by energizing and de-energizing a first electrical actuator 50. In particular, a first control valve member 51 is normally biased downward into contact with a seat 52 to fluidly block a fluid connection between first control chamber 66 and drain outlet 65. When first electrical actuator 50 is energized, first control valve member 51 lifts out of contact with seat 52 to fluidly connect first control chamber 66 to drain outlet 65, relieving pressure on closing hydraulic surface 72 to allow first check valve member 71 to lift upwards toward its open position responsive to fluid pressure acting on opening hydraulic surface 77, which is always exposed to fluid pressure of first fuel inlet 61, and hence first common rail 11. First check valve member 71 may be hydraulically balanced when pressure in first control chamber 66 is high, such that a first spring 91 is operably positioned to bias the first check valve member 71 toward its closed position. Although not necessary, first check valve member 71 may consist of a single piece of metallic material with the closing hydraulic surface 72 at one end and a valve surface 75 that contacts first seat 73 at an opposite end. A single piece means that the entire component was formed from a uniform body of material into the shape shown, without any attachments through threads, welding, adhesives or the like. The first check valve member 71 moves along a first centerline 78 between its open and closed positions. The illustrated embodiment, first control chamber 66 is always fluidly connected to the pressure in first fuel inlet 61 and hence first common rail 11, via an A-orifice 100. The fluid connection between first control chamber 66 and seat 52 includes a Z-orifice 101. Nevertheless, those skilled in the art will appreciate that the control of pressure in first control chamber 66 may be accomplished using other strategies known in the art, such as a three way valve strategy rather than the two way valve strategy illustrated without departing from the scope of the present disclosure. In the illustrated embodiment, first check valve member 71 is guided in its movement via a guide interaction 112 with a spring cage 42 of injector body 40. Nevertheless, other guiding strategies would also fall within the intended scope of the present disclosure.

A second direct operated check 80 includes a second check valve member 81 with a closing hydraulic surface 82 exposed to fluid pressure in the second control chamber 67. Second check valve member 81 is movable along a second centerline 88 between a closed position (as shown) in contact with a second seat 83 to fluidly block the second nozzle outlet set 64 to the second fuel inlet 62, and an open position out of contact with the second seat 83 to fluidly connect the second fuel inlet 62 to the second nozzle outlet set 64 to facilitate a gaseous fuel injection event. Although not visible in the sectioned views of FIGS. 2 and 4, the fluid connection between second fuel inlet 62 and second nozzle outlet set 64 can be seen in the sectioned view of FIG. 3. Second direct operated check 80 also includes a second spring 92 that is operably positioned to bias the second check valve member 81 toward its downward closed position. The opening and closing movement of second check valve member 81 may be controlled by a second electrical actuator 53. A second control valve member 54 will be biased into contact with a seat 55 to fluidly block second control chamber 67 to drain outlet 65 when second electrical actuator 53 is de-energized. When second electrical actuator 53 is energized, second control valve member 54 can lift out of contact with seat 55 to fluidly connect second control chamber 67 to drain outlet 65 via a Z-orifice 103. This allows pressure in second control chamber 67 to drop, allowing second check valve member 81 to lift to its upward open position against the action of second spring 92 responsive to liquid fuel pressure acting on opening hydraulic surface 87. Like opening hydraulic surface 77 of first check valve member 71, opening hydraulic surface 87 of second check valve member 81 are always exposed to the fluid pressure in first fuel inlet 61, and hence the pressure in first common rail 11. In addition, second control chamber 67 is always fluidly connected to first fuel inlet 61 via an A-orifice 102. Although the pressure control in second control chamber 67 is facilitated by a two-way valve in the illustrated embodiment, those skilled in the art will appreciate that three-way valve strategies would also fall within the intended scope of the present disclosure. Although not necessary, second check valve member 81 is also preferably a single piece with the closing hydraulic surface 82 at one end and a valve surface 85 that contacts a second seat 83 at an opposite end. Second check valve member 81 may be guided in its movement between its open and closed positions via a guide interaction 113 with a tip piece 41 of injector body 40, and at a second guide interaction 114 with spring cage 42. As used in the present disclosure, a guide interaction means a close diametrical clearance between the outer diameter of the guided piece, and inner diameter of the stationary piece. In the illustrated embodiment, these guide lengths may be sufficiently long to substantially fluidly isolate spring chamber 56 from both gas nozzle chamber 89 and second control chamber 67. However, one could expect some small migration of liquid diesel fuel from spring chamber 56 into gas nozzle chamber 89 due to the pressure differential between first common rail 11 and second common rail 12. However, this migration might be desirable to maintain lubrication in guide interaction 113 as well as maintaining a lubricated interaction between valve surface 85 and second seat 83.

In the illustrated embodiment, first control valve member 51 and second control valve member 54 are substantially identical and interact with flat seats 52 and 55, respectively. Nevertheless, those skilled in the art will appreciate that seats 52 and 55 could have a different shape, such as conical, without departing from the scope of the present disclosure. In addition, first electrical actuator 50 and second electrical actuator 53 are shown as being identical and positioned side by side in injector body 40. Nevertheless, those skilled in the art will appreciate that different electrical actuators and different packaging arrangements could also fall within the scope of the present disclosure.

In order to accommodate first spring 91 and second spring 92 with sufficient pre-loads and sizes to obtain performance from fuel injector 13 as desired, first spring 91 and second spring 92 are located on opposite sides of a plane 93 that is oriented perpendicular to a long axis 94 of the injector body 40. In addition, the outer radius 96 of first spring 91 plus an outer radius 97 of the second spring 92 may be greater than a distance 95 between the first centerline 78 and the second centerline 88 to accommodate the different sized springs while maintaining a small distance 95 to locate the first and second nozzle outlet sets 63, 64 as illustrated. As shown, tip piece 41 is in contact with spring cage 42. In addition, tip piece 41 defines the first nozzle outlet set 63 and the second nozzle outlet set 64, that are in close proximity so as to be positioned close to the centerline of the engine cylinders 9, which can avoid a possible necessity of asymmetrical spray patterns. Nevertheless, first nozzle outlet set 63 and second nozzle outlet set 64 can have any known number of nozzle outlets arranged to produce any symmetrical or asymmetrical spray pattern without departing from the present disclosure. Also as shown, the first spring 91 and the second spring 92 are both positioned in a common spring chamber 56 defined by spring cage 42.

Figure 5:
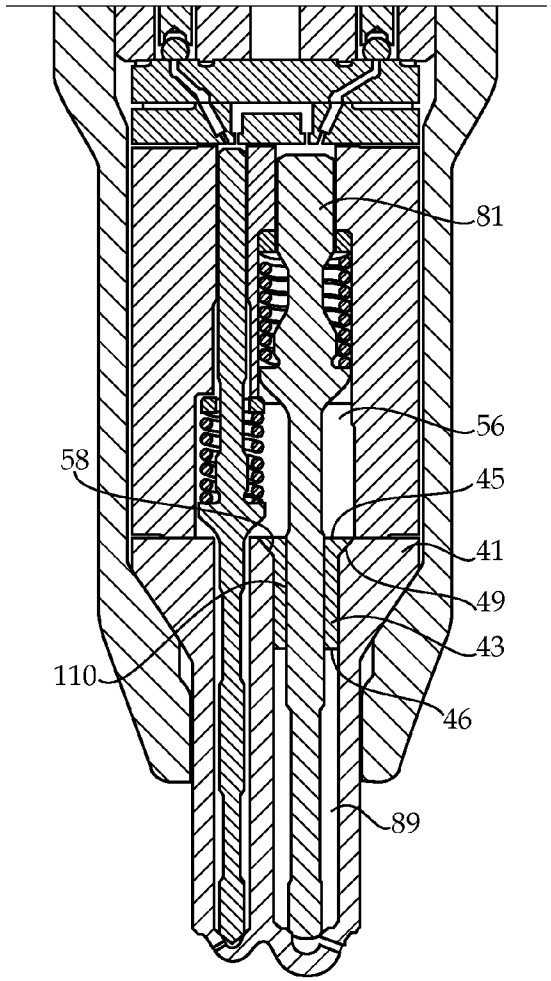
FIG. 5 is a partial front sectioned diagrammatic view of a fuel injector according to another aspect of the present disclosure.

Referring now to FIG. 5, a slightly modified version includes a insert 43 with one side 45 exposed to fluid pressure in spring chamber 56, and hence first fuel inlet 61 and first common rail 11, and a second opposite side 46 exposed to fluid pressure in gas nozzle chamber 89, and hence second fuel inlet 62 and second common rail 12. Insert 43 may include a spherical surface 49 that is seated in contact with a conical seat 58 in order to fluidly isolate spring chamber 56 from gas nozzle chamber 89 around an outer surface of insert 43. In addition, insert 43 may have a guide interaction 110 with second check valve member 81 to guide the movement of second check valve member 81. As discussed earlier, one might expect some amount of liquid fuel to migrate from spring chamber 56 along guide interaction 110 to gaseous nozzle chamber 89 to maintain lubrication both for guiding and at the seat. This structure may relax some alignment issues associated with accurately aligning the two guide interactions 114 and 113 of the embodiment of FIGS. 2-4. The pressure differential between spring chamber 56 and gas nozzle chamber 89 may serve to maintain insert 43 in seated contact with conical seat 58.

Figure 6:
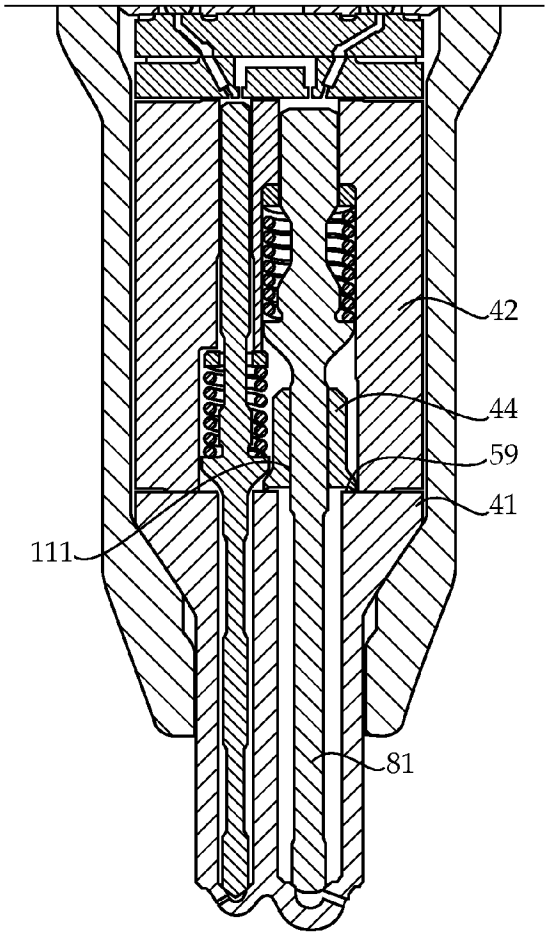
FIG. 6 is an enlarged partial front sectioned diagrammatic view of a fuel injector according to still another aspect of the present disclosure.

Referring now to FIG. 6, still another variation includes an insert 44 that is positioned entirely inside of spring cage 42 rather than partially inside of spring cage 42 and tip piece 41 as in the in the embodiment of FIG. 5. This embodiment also differs in that insert 44 is held in sealing contact with a flat seat 59, which is located on the top surface of tip piece 41. Like the previous embodiment, insert 44 has a guide interaction 111 with second check valve member 81.

Figure 7:
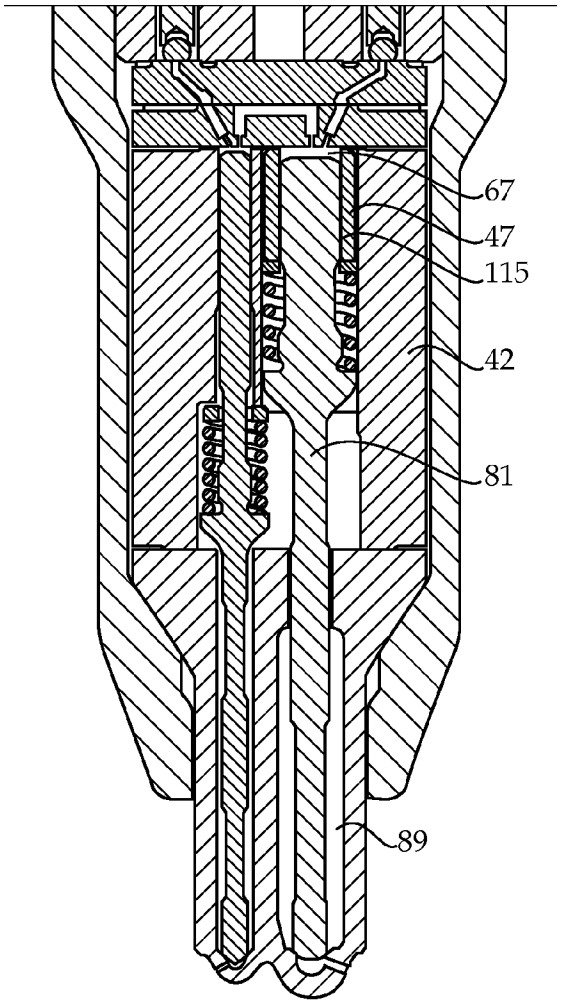
FIG. 7 is an enlarged partial front sectioned diagrammatic view of a fuel injector according to still another aspect of the present disclosure.

Referring in addition to FIG. 7, still another variation includes an insert 47 that is a separate piece from spring cage 42. In this embodiment, insert 47 defines a portion of second control chamber 67 and has a guide interaction 115 with second check valve member 81. Like the previous embodiment, insert 47 is positioned inside of spring cage 42.

Figure 8:
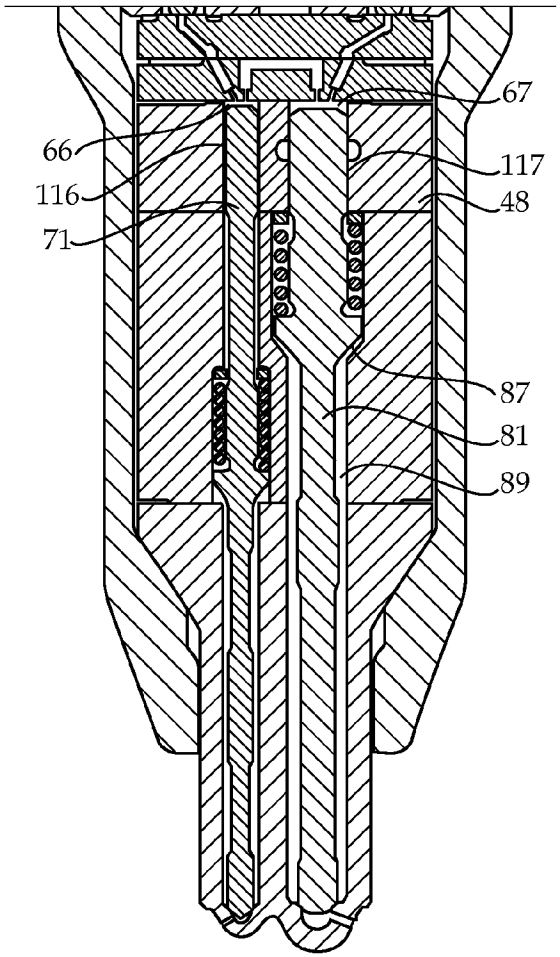
FIG. 8 is a enlarged partial front sectioned diagrammatic view of a fuel injector according to another aspect of the present disclosure.

Referring to FIG. 8, still another embodiment differs from all of the previous embodiments in that the opening hydraulic surface 87 of second check valve member 81 is exposed to gas pressure in gas nozzle chamber 89, rather than liquid fuel pressure in the spring chamber 56 as in the previous embodiments. This embodiment also differs in that the first and second check valve members 71, 81 have guide interactions 116 and 117, respectively, with a guide piece 48 that is in contact with spring cage 42. In this embodiment, guide piece 48 defines a portion of first control chamber 66 and second control chamber 67, which is also different from the previous embodiments. Thus, in the embodiment of FIG. 8, the second check valve member 81 has an opening hydraulic surface 87 exposed to fluid pressure in the second fuel inlet 62 and hence the second common rail 12 (FIG. 1) whereas the embodiments of FIGS. 2-7 all have the opening hydraulic surface 87 of second check valve member 81 exposed to fluid pressure in the first fuel inlet 61 and hence the first common rail 11.

INDUSTRIAL APPLICABILITY

The present disclosure finds potential application in any dual fuel application. The present disclosure finds particular applicability in dual fuel common rail systems, and especially those in which the two fuels differ in pressure, chemical identity and matter phase. Nevertheless, the present disclosure could find potential application in dual fuel systems where the fuels differ in less than all three of these categories. The offset spring locating strategy of the present disclosure also helps to facilitate both single piece check valve members and serves to help maintain the first and second nozzle outlet sets 63, 64 in close proximity, which can help to avoid potential use of exotic spray patterns in order to maintain good combustion characteristics in an installed engine.

When in operation, each fuel injector 13 will inject liquid fuel through the first nozzle outlet set 63 by relieving pressure on closing hydraulic surface 72 of first check valve member 71 by energizing the first electrical actuator 50. When this is done, the liquid fuel inlet 61 will be fluidly connected to drain outlet 65 by way of A-orifice 100, first control chamber 66, and Z-orifice 101 past seat 52. A liquid injection event is ended by pushing the first check valve member 71 toward first seat 73 with first spring 91. Gaseous fuel is injected through the second nozzle outlet set 64 by relieving pressure on closing hydraulic surface 82 by energizing second electrical actuator 53. When this is done, the first or liquid fuel inlet 61 becomes fluidly connected to the drain outlet 65 by way of A-orifice 102, second control chamber 67, Z-orifice 103 and past seat 55. A gaseous fuel injection event is ended by pushing the second check valve member 81 toward the second seat 83 with the second spring 92.

As stated earlier, in order to accommodate the desired spring sizes and pre-loads, the first spring 91 is located on opposite side of the plane 93 along long axis 94 with respect to the second spring 92. In the embodiments of FIGS. 2-7, both the first check valve member 71 and the second check valve member 81 are moved toward their respective open positions with liquid fuel pressure acting on respective opening hydraulic surfaces 77 and 87. In the embodiment of FIG. 8, the second check valve member 81 is pushed toward its open position with gas pressure acting on the opening hydraulic surface 87. In some of the embodiments, the second check valve member 81 has its movement guided via a guide interaction with an insert 43, 44 or 47. Those skilled in the art will appreciate that inserts could also be utilized with regard to the first check valve member 71 without departing from the present disclosure, such as to relax alignment requirements between the spring cage 42 and the tip piece 41. For instance, it might be desirable to use an insert similar to insert 47 on the liquid check valve member 71 without departing from the intended scope of the present disclosure.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A fuel injector comprising:

an injector body defining a first fuel inlet, a second fuel inlet, a first nozzle outlet set, and a second nozzle outlet set, the injector body further defining therein a first control chamber and a second control chamber;

a first direct operated check that includes a first check valve member with a closing hydraulic surface exposed to a fluid pressure in the first control chamber, and being movable between a closed position in contact with a first seat to block the first nozzle outlet set from the first fuel inlet, and an open position out of contact with the first seat to fluidly connect the first fuel inlet to the first nozzle outlet set, and further including a first spring operably positioned to bias the first check valve member toward the closed position; and a second direct operated check that includes a second check valve member with a closing hydraulic surface exposed to a fluid pressure in the second control chamber, and being movable between a closed position in contact with a second seat to block the second nozzle outlet set from the second fuel inlet, and an open position out of contact with the second seat to fluidly connect the second fuel inlet to the second nozzle outlet set, and further including a second spring operably positioned to bias the second check valve member toward the closed position;

the first spring and the second spring being located entirely on opposite sides of a plane oriented perpendicular to a long axis of the injector body; and a centerline of the first check valve member being separated from a centerline of the second check valve member by a distance, the distance being greater than zero.

2. The fuel injector of claim 1 wherein the first check valve member is a single piece with the closing hydraulic surface of the first check valve member at one end of the first check valve member and a valve surface that contacts the first seat at an opposite end of the first check valve member; and the second check valve member is a single piece with the closing hydraulic surface of the second check valve member at one end of the second check valve member and a valve surface that contacts the second seat at an opposite end of the second check valve member.

3. The fuel injector of claim 1 wherein an outer radius of the first spring plus an outer radius of the second spring is greater than the distance.

4. The fuel injector of claim 1 wherein the first control chamber and the second control chamber are fluidly connected to the first fuel inlet.

5. The fuel injector of claim 4 wherein the first check valve member has an opening hydraulic surface exposed to a fluid pressure in the first fuel inlet; and the second check valve member has an opening hydraulic surface exposed to the fluid pressure in the first fuel inlet.

6. The fuel injector of claim 4 wherein the first check valve member has an opening hydraulic surface exposed to a fluid pressure in the first fuel inlet; and the second check valve member has an opening hydraulic surface exposed to a fluid pressure in the second fuel inlet.

7. The fuel injector of claim 1 wherein the injector body includes a tip piece in contact with a spring cage;

the tip piece defines the first nozzle outlet set and the second nozzle outlet set;

the first spring and the second spring are positioned inside the spring cage;

the first check valve member is a single piece with the closing hydraulic surface of the first check valve member at one end of the first check valve member and a valve surface that contacts the first seat at an opposite end of the first check valve member; and the second check valve member is a single piece with the closing hydraulic surface of the second check valve member at one end of the second check valve member and a valve surface that contacts the second seat at an opposite end of the second check valve member.

8. The fuel injector of claim 7 wherein the second check valve member has a guide interaction with an insert positioned inside at least one of the tip piece and the spring cage.

9. The fuel injector of claim 8 wherein the insert has one side exposed to a fluid pressure in the first fuel inlet, and an opposite side exposed to a fluid pressure in the second fuel inlet.

10. The fuel injector of claim 7 wherein the injector body includes a guide piece in contact with the spring cage and defining a portion of first control chamber and the second control chamber; and each of the first check valve member and the second check valve member has a guide interaction with the guide piece.

11. A common rail fuel system comprising:

a first common rail;

a second common rail;

a plurality of fuel injectors that each includes:

an injector body defining a first fuel inlet fluidly connected to the first common rail, a second fuel inlet fluidly connected to the second common rail, a first nozzle outlet set, and a second nozzle outlet set, the injector body further defining therein a first control chamber and a second control chamber;

a first direct operated check that includes a first check valve member with a closing hydraulic surface exposed to a fluid pressure in the first control chamber, and being movable between a closed position in contact with a first seat to block the first nozzle outlet set from the first fuel inlet, and an open position out of contact with the first seat to fluidly connect the first fuel inlet to the first nozzle outlet set, and further including a first spring operably positioned to bias the first check valve member toward the closed position;

a second direct operated check that includes a second check valve member with a closing hydraulic surface exposed to a fluid pressure in the second control chamber, and being movable between a closed position in contact with a second seat to block the second nozzle outlet set from the second fuel inlet, and an open position out of contact with the second seat to fluidly connect the second fuel inlet to the second nozzle outlet set, and further including a second spring operably positioned to bias the second check valve member toward the closed position;

the first spring and the second spring being located entirely on opposite sides of a plane oriented perpendicular to a long axis of the injector body;

a centerline of the first check valve member being separated from a centerline of the second check valve member by a distance, the distance being greater than zero.

12. The common rail fuel system of claim 11 wherein the first check valve member is a single piece with the closing hydraulic surface of the first check valve member at one end of the first check valve member and a valve surface that contacts the first seat at an opposite end of the first check valve member along a first centerline;

the second check valve member is a single piece with the closing hydraulic surface of the second check valve member at one end of the second check valve member and a valve surface that contacts the second seat at an opposite end of the second check valve member along a second centerline; and an outer radius of the first spring plus an outer radius of the second spring is greater than the distance.

13. The common rail fuel system of claim 12 wherein the first control chamber and the second control chamber are fluidly connected to the first fuel inlet;

the first check valve member has an opening hydraulic surface exposed to a fluid pressure in the first fuel inlet; and the second check valve member has an opening hydraulic surface exposed to the fluid pressure in the first fuel inlet.

14. The common rail fuel system of claim 13 wherein the injector body includes a tip piece in contact with a spring cage;

the tip piece defines the first nozzle outlet set and the second nozzle outlet set;

the first spring and the second spring are positioned inside the spring cage;

the first check valve member is a single piece with the closing hydraulic surface of the first check valve member at one end of the first check valve member and a valve surface that contacts the first seat at an opposite end of the first check valve member; and the second check valve member is a single piece with the closing hydraulic surface of the second check valve member at one end of the second check valve member and a valve surface that contacts the second seat at an opposite end of the second check valve member.

15. The common rail fuel system of claim 14 wherein the second check valve member has a guide interaction with an insert positioned inside at least one of the tip piece and the spring cage.

16. The common rail fuel system of claim 15 wherein the insert has one side exposed to the fluid pressure in the first fuel inlet, and an opposite side exposed to the fluid pressure in the first fuel inlet.

17. The common rail fuel system of claim 14 wherein the injector body includes a guide piece in contact with the spring cage and defining a portion of the first control chamber and the second control chamber; and each of the first check valve member and the second check valve member has a guide interaction with the guide piece.

18. A method of operating a fuel injector, comprising the steps of:

injecting a liquid fuel through a first nozzle outlet set;

injecting a gaseous fuel through a second nozzle outlet set;

the liquid fuel injecting step includes relieving a pressure on a closing hydraulic surface of a first check valve member by fluidly connecting a liquid fuel inlet to a drain outlet through a first control chamber;

the gaseous fuel injecting step includes relieving a pressure on a closing hydraulic surface of a second check valve member by fluidly connecting the liquid fuel inlet to the drain outlet through a second control chamber;

ending a liquid fuel injection event by pushing the first check valve member toward a first seat with a first spring;

ending a gaseous injection event by pushing the second check valve member toward a second seat with a second spring, the first spring and the second spring being located entirely on opposite sides of a plane perpendicular to a long axis of the fuel injector; and a centerline of the first check valve member being separated from a centerline of the second check valve member by a distance, the distance being greater than zero.

19. The method of claim 18 wherein the liquid fuel injecting step includes pushing the first check valve member toward an open position with a liquid pressure acting on an opening hydraulic surface of the first check valve member; and the gaseous fuel injecting step includes pushing the second check valve member toward an open position with a liquid pressure acting on an opening hydraulic surface of the second check valve member.

20. The method of claim 19 including a step of guiding movement of the second check valve member with a guide interaction with an insert.

* * * * *